US005203986A

United States Patent [19]

Shiohara et al.

[11] Patent Number: 5,203,986

[45] Date of Patent: Apr. 20, 1993

[54] METHOD FOR MANUFACTURING ELECTROGALVANIZED STEEL SHEET EXCELLENT IN SPOT WELDABILITY

[75] Inventors: Yukimitsu Shiohara; Masaki Abe, both of Tokyo, Japan

[73] Assignee: NKK Corporation, Tokyo, Japan

[21] Appl. No.: 657,665

[22] Filed: Feb. 19, 1991

[30] Foreign Application Priority Data

Mar. 8, 1990 [JP] Japan ..... 2-57689
Mar. 13, 1990 [JP] Japan ..... 2-61961

[51] Int. Cl.[5] ..... C25D 3/22

[52] U.S. Cl. ..... 205/305; 205/306; 205/311

[58] Field of Search ..... 205/305, 306, 311

[56] References Cited

U.S. PATENT DOCUMENTS 3,887,445 6/1975 Jackson ..... 205/311
3,972,788 8/1976 Passal ..... 205/305
4,877,497 10/1989 Watanabe et al. ..... 205/311
4,957,594 9/1990 Yamazaki et al. ..... 205/305

FOREIGN PATENT DOCUMENTS 1-205090 8/1989 Japan .
1-252795 10/1989 Japan .
1-252796 10/1989 Japan .
1419613 12/1975 United Kingdom .

OTHER PUBLICATIONS

Patent Abstracts of Japan, vol. 13, No. 510 (C-654)[3858], Nov. 15, 1989, for JP-A-2 05 090 (Nippon Steel Corp.) Aug. 17, 1989, Japan.

*Primary Examiner*—John Niebling
*Assistant Examiner*—Brian M. Bolan
*Attorney, Agent, or Firm*—Frishauf, Holtz, Goodman & Woodward

[57] ABSTRACT

A method for manufacturing an electrogalvanized steel sheet excellent in spot weldability, which comprises the steps of: adding, into an acidic electrogalvanizing solution containing an oxidizer, a complexing agent, which is capable of forming a stable complex with zinc, in an amount within a range of from 0.001 to 10 moles per liter of the electrogalvanizing solution, or a pH buffer, which has a pH buffering effect in a solution having a pH value within a range of from 5 to 12, in an amount within a range of from 1 to 50 g per liter of the electrogalvanizing solution; and electrogalvanizing a steel sheet in the resultant acidic electrogalvanizing solution containing the complexing agent or the pH buffer in addition to the oxidizer, to form a galvanizing layer comprising zinc oxide or zinc hydroxide on the surface of the steel sheet.

13 Claims, No Drawings

METHOD FOR MANUFACTURING ELECTROGALVANIZED STEEL SHEET EXCELLENT IN SPOT WELDABILITY

REFERENCE TO PATENTS, APPLICATIONS AND PUBLICATIONS PERTINENT TO THE INVENTION

As far as we know, there is available the following prior art document pertinent to the present invention:

Japanese Patent Provisional Publication No. 1-205,090 dated Aug. 17, 1989.

The contents of the prior art disclosed in the above-mentioned prior art document will be discussed hereafter under the heading of the "BACKGROUND OF THE INVENTION".

FIELD OF THE INVENTION

The present invention relates to a method for manufacturing an electrogalvanized steel sheet excellent in spot weldability.

BACKGROUND OF THE INVENTION

It is a usual practice to spot-welding together two electrogalvanized steel sheets placed one on top of the other. The spot welding comprises pinching two electrogalvanized steel sheets placed one on top of the other between a pair of electrode tips made of copper, and electrifying the pair of electrode tips while pressing the electrogalvanized steel sheets against each other by means of the pair of electrode tips, to electric-resistance-welding together these two electrogalvanized steel sheets.

When spot-welding together two electrogalvanized steel sheets, the following problem is encountered: The galvanizing layers of the weld zone of the two electrogalvanized steel sheets are melted by the welding heat generated upon the spot welding. The resultant molten zinc of the galvanizing layers reacts with copper contained in the pair of electrode tips to produce a hard and brittle zinc-copper alloy layer on each of the pair of electrode tips. This results in a violent wear of the electrode tips, thus leading to a lower spot weldability including a shorter service life of the electrode tips and a impaired electric conductivity thereof.

As a method for solving the above-mentioned problem and manufacturing an electrogalvanized steel sheet excellent in spot weldability, the following method is proposed:

A method for manufacturing an electrogalvanized steel sheet excellent in spot weldability, as disclosed in Japanese Patent Provisional Publication No. 1-205,090 dated Aug. 17, 1989, which comprises the steps of: electrogalvanizing a steel sheet in an acidic electrogalvanizing solution containing hydrogen peroxide in an amount within a range of from 0.5 to 30 % to form, on at least one surface of said steel sheet, a galvanizing layer comprising zinc oxide or zinc hydroxide, in an amount within a range of from 0.03 to 3.0 g/m$^2$ per surface of said steel sheet (hereinafter referred to as the "Prior Art").

According to the above-mentioned Prior Art, it is possible to manufacture an electrogalvanized steel sheet excellent in spot weldability, having, on at least one surface thereof, a galvanizing layer comprising zinc oxide or zinc hydroxide. The galvanizing layer comprising zinc oxide or zinc hydroxide hardly reacts with copper. When spot-welding, therefore, almost no zinc-copper alloy layer is produced on each of the pair of electrode tips, through the reaction of zinc with copper, thus inhibiting wear of the electrode tips. Furthermore, the galvanizing layer comprising zinc oxide or zinc hydroxide is high in melting point and electric resistance. The galvanizing layer comprising zinc oxide or zinc hydroxide is therefore excellent in spot weldability.

When electrogalvanizing a steel sheet in an acidic electrogalvanizing solution containing hydrogen peroxide as in the Prior Art, a galvanizing layer comprising zinc oxide or zinc hydroxide is formed on at least one surface of the steel sheet, and the reason of this is estimated to be as follows:

When electrogalvanizing a steel sheet in an acidic electrogalvanizing solution containing hydrogen peroxide as an oxidizer, the reduction reaction of zinc ions causes the increase to 5.6 in the pH value of the acidic electrogalvanizing solution on the interface of the cathode, i.e., the steel sheet, and the reduction reaction of hydrogen peroxide as the oxidizer further increases the above-mentioned pH value to over 5.6. This increase in the pH value of the electrogalvanizing solution on the interface of the cathode causes the precipitation of zinc oxide or zinc hydroxide on the surface of the steel sheet as the cathode. A galvanizing layer comprising zinc oxide or zinc hydroxide can thus be formed on at least one surface of the steel sheet.

However, the above-mentioned Prior Art has the following problems: As described above, the pH value of the electrogalvanizing solution on the interface of the cathode, i.e., the steel sheet increases to over 5.6 under the effect of the reduction reaction of the oxidizer contained in the acidic electrogalvanizing solution. As a result, there is an increase in the weight of the galvanizing layer comprising zinc oxide or zinc hydroxide formed on at least one surface of the steel sheet. However, if the weight of the thus formed galvanizing layer comprising zinc oxide or zinc hydroxide becomes excessive, the welding current becomes difficult to flow upon application of the spot welding. This leads to a lower spot weldability of the electrogalvanized steel sheet, and moreover, to a poorer workability thereof. According to the present inventors' research, the weight of the galvanizing layer comprising zinc oxide or zinc hydroxide, which is capable of improving spot weldability, is within a range of from 0.05 to 1.00 g/m$^2$ per surface of the steel sheet.

The content of the oxidizer in the acidic electrogalvanizing solution sensively affects the pH value of the electrogalvanizing solution on the interface of the cathode. When the pH value of the electrogalvanizing solution on the interface of the cathode decreases to 5.6 or under, the weight of the galvanizing layer comprising zinc oxide or zinc hydroxide decreases to under 0.05 g/m$^2$ per surface of the steel sheet, thus degrading spot weldability. When the above-mentioned pH value increases to over 12, on the other hand, the weight of the above-mentioned galvanizing layer increases to over 1.0 g/m$^2$ per surface of the steel sheet, thus also degrading spot weldability. The range of the content of the oxidizer, which is capable of improving spot weldability of the electrogalvanized steel sheet, is therefore very narrow.

Upon electrogalvanizing a steel sheet, it is very difficult to keep the content of the oxidizer in the acidic electrogalvanizing solution within a narrow range which can improve spot weldability. It is therefore very difficult to stably manufacture an electrogalvanized steel sheet excellent in spot weldability, having on at least one surface thereof, a galvanizing layer comprising zinc oxide or zinc hydroxide, in an amount appropriate for improving spot weldability.

Under such circumstances, there is a strong demand for the development of a method for stably manufacturing an electrogalvanized steel sheet excellent in spot weldability, which has on at least one surface thereof a galvanizing layer comprising zinc oxide or zinc hydroxide, in an amount appropriate for improving spot weldability, but such a method has not as yet been proposed.

SUMMARY OF THE INVENTION

An object of the present invention is therefore to provide a method for stably manufacturing an electrogalvanized steel sheet excellent in spot weldability, which has on at least one surface thereof a galvanizing layer comprising zinc oxide or zinc hydroxide, in an amount appropriate for improving spot weldability.

In accordance with one of the features of the present invention, there is provided, in a method for manufacturing an electrogalvanized steel sheet excellent in spot weldability, which comprises the steps of: electrogalvanizing a steel sheet in an acidic electrogalvanizing solution containing an oxidizer to form, on at least one surface of said steel sheet, a galvanizing layer comprising zinc oxide or zinc hydroxide; the improvement wherein: said acidic electrogalvanizing solution further contains a complexing agent, which is capable of forming a stable complex with zinc, in an amount within a range of from 0.001 to 10 moles per liter of said electrogalvanizing solution, or a pH buffer, which has a pH buffering effect in a solution having a pH value within a range of from 5 to 12, in an amount within a range of from 1 to 50 g per liter of said electrogalvanizing solution.

DETAILED DESCRIPTION OF PREFERRED EMBODIMENTS

From the above-mentioned point of view, extensive studies were carried out to develop a method for stably manufacturing an electrogalvanized steel sheet excellent in spot weldability, which has on at least one surface thereof a galvanizing layer comprising zinc oxide or zinc hydroxide in an amount appropriate for improving spot weldability. As a result, the following findings were obtained:

By electrogalvanizing a steel sheet in an acidic electrogalvanizing solution containing, in addition to an oxidizer, a complexing agent in a prescribed amount or a pH buffer in a prescribed amount, it is possible to prevent the pH value of the electrogalvanizing solution on the interface of the cathode, i.e., the steel sheet from decreasing to 5.6 or under and increasing to over 12. This expands the range of the content of the oxidizer in the electrogalvanizing solution, which permits a stable formation, on at least one surface of the steel sheet, of a galvanizing layer comprising zinc oxide or zinc hydroxide in an amount appropriate for improving spot weldability of the electrogalvanized steel sheet.

The present invention was made on the basis of the above-mentioned findings. Now, the method of the present invention is described below.

In the present invention, when electrogalvanizing a steel sheet in an acidic electrogalvanizing solution containing an oxidizer, there is added to the electrogalvanizing solution, a complexing agent in an amount within a range of from 0.001 to 10 moles per liter of the electrogalvanizing solution, or a pH buffer in an amount within a range of from 1 to 50 g per liter of the electrogalvanizing solution.

By electroplating the steel sheet in the acidic electrogalvanizing solution containing the complexing agent or the pH buffer in addition to the oxidizer, it is possible to prevent the pH value of the electrogalvanizing solution on the interface of the cathode, i.e., the steel sheet from decreasing to 5.6 or under and increasing to over 12. Consequently, the weight of the galvanizing layer comprising zinc oxide or zinc hydroxide never decreases to under 0.05 $g/m^2$ per surface of the steel sheet nor increases to over 1.0 $g/m^2$ per surface of the steel sheet. This expands the range of the content of the oxidizer in the electrogalvanizing solution, which permits a stable formation, on at least one surface of the steel sheet, of the galvanizing layer comprising zinc oxide or zinc hydroxide in an amount appropriate for improving spot weldability of the electrogalvanized steel sheet.

The complexing agent should have the ability to form a stable complex with zinc. The ability of the complexing agent to form a stable complex with zinc means a degree of stability of the complex with zinc of at least 1.0 in an acidic electrogalvanizing solution having a pH value of 6. With a complexing agent not having the ability to form a stable complex with zinc, i.e., a complexing agent having a degree of stability of under 1.0 of the complex with zinc in an acidic electrogalvanizing solution having a pH value of 6, it is impossible to prevent the pH value of the electrogalvanizing solution on the interface of the cathode from decreasing to 5.6 or under and increasing to over 12.

The content of the above-mentioned complexing agent should be within a range of from 0.001 to 10 moles per liter of the acidic electrogalvanizing solution. With a content of the complexing agent of under 0.001 mole per liter of the electrogalvanizing solution, it is impossible to prevent the pH value of the electrogalvanizing solution on the interface of the cathode from decreasing to 5.6 or under and increasing to over 12. With a content of the complexing agent of over 10 moles per liter of the electrogalvanizing solution, on the other hand, the electrolytic efficiency of the electrogalvanizing solution decreases, thus causing a burnt deposit and hence the problem of a deteriorated quality of the product.

Examples of the desirable complexing agent used in the present invention are presented below:

- Ethylenediamine disodium tetraacetate (hereinafter referred to as "EDTA-Na3[);
- Citric acid ions;
- Oxalic acid ions;
- Tartaric acid ions; Trans-1. 2-cyclohexane-diamine-N.N.N'.N'-tetraacetic acid (hereinafter referred to as "CyDTA"),
- Diethylene triamine pentaacetic acid (hereinafter referred to as "DTPA"); and
- Ethylenedioxybis (ethylamine)-N.N.N'.N'-tetraacetic acid (hereinafter referred to as "GEDTA").

The pH buffer should have a pH buffering effect in a solution having a pH value within a range of from 5 to 12. With a pH buffer having a pH buffering effect only in a solution having a pH value of under 5 or over 12, it is impossible to prevent the pH value of the electrogalvanizing solution on the interface of the cathode from decreasing to 5.6 or under and increasing to over 12.

The content of the above-mentioned pH buffer should be within a range of from 1 to 50 g per liter of the acidic electrogalvanizing solution. With a content of the pH buffer of under 1 g per liter of the electrogalvanizing solution, it is impossible to prevent the pH value of the electrogalvanizing solution on the interface of the cathode from decreasing to 5.6 or under and increasing to over 12. With a content of the pH buffer of over 50 g per liter of the electrogalvanizing solution, on the other hand, no further improvement of the above-mentioned effect is available, leading to a higher cost.

Examples of the desirable pH buffer used in the present invention are presented below:

Clark-Lubs' pH buffer (hereinafter referred to as the "buffer A");

S ϕ rens' pH buffer (hereinafter referred to as the "buffer B");

Koltoff's pH buffer (hereinafter referred to as the "buffer C");

Michaelis' pH buffer (hereinafter referred to as the "buffer D");

Atkins-Pantin's pH buffer (hereinafter referred to as the "buffer E");

Palitzsch's pH buffer (hereinafter referred to as the "buffer F");

McIlvaine's pH buffer (hereinafter referred to as the "buffer G");

Menzel's pH buffer (hereinafter referred to as the "buffer H");

Walpeole's pH buffer (hereinafter referred to as the "buffer I");

Hasting-Sendroy's pH buffer (hereinafter referred to as the "buffer J");

Britton-Robinson's pH buffer (hereinafter referred to as the "buffer K");

Gomori's pH buffer (hereinafter referred to as the "buffer L");

Isotonic pH buffer (hereinafter referred to as the "buffer M"); and

N-ethylmorpholine-hydrochloric acid pH buffer (hereinafter referred to as the "buffer N").

The weight of the galvanizing layer comprising zinc oxide or zinc hydroxide should be within a range of from 0.05 to 1.00 g/m$^2$ per surface of the steel sheet. With a weight of the above-mentioned galvanizing layer of under 0.05 g/m$^2$ or over 1.00 g/m$^2$ per surface of the steel sheet, only a poor spot weldability is available. Furthermore, a weight of the above-mentioned galvanizing layer of over 1.00 g/m$^2$ per surface of the steel sheet leads also to a degraded workability of the electrogalvanized steel sheet.

As the oxidizer which is added into the acidic electrogalvanizing solution, hydrogen peroxide ($H_2O_2$), nitrous acid ions ($NO_2^-$), nitric acid ions ($NO_3^-$), bromic acid ions ($BrO_3^-$), iodic acid ions ($IO_3^-$) or selenic acid ions ($SeO_3^{2-}$) are applicable. An appropriate content of the oxidizer in the acidic electrogalvanizing solution should be selected, taking account of the oxidizing ability of a particular oxidizer.

The steel sheet on at least one surface of which the galvanizing layer comprising zinc oxide or zinc hydroxide is to be formed, may be a steel sheet not subjected to a surface treatment such as a cold-rolled steel sheet or a hot-rolled steel sheet, or a conventional electrogalvanized steel sheet, or a conventional zinc-alloy-electroplated steel sheet having a plating layer which contains, in addition to zinc, at least one of iron, nickel, cobalt and chromium.

As the basic plating solution, a sulfuric acid plating solution, a chloride plating solution or a mixed plating solution of sulfuric acid and chloride, which are all conventional, may be used. An electric conductivity assistant and/or a glossing agent may additionally be added into the above-mentioned basic plating solution, as required.

Now, the present invention is described more in detail by means of examples while comparing with examples for comparison.

EXAMPLE 1

An acidic electrogalvanizing solution comprising the following constituents (hereinafter referred to as the "fundamental electrogalvanizing solution") was used:

| | |
|---|---|
| zinc sulfate | 300 g/l |
| sodium sulfate | 30 g/l |
| sodium acetate | 12 g/l |
| pH value | 2 |

An oxidizer and a complexing agent in an amount within the scope of the method of the present invention were added, as shown in Table 1, to the above-mentioned fundamental electrogalvanizing solution, to prepare acidic electrogalvanizing solutions of the present invention (hereinafter referred to as the "electrogalvanizing solutions of the invention") Nos. 1 to 27. Then, a cold-rolled steel sheet having a thickness of 0.8 mm was electrogalvanized in each of the electrogalvanizing solutions of the invention Nos. 1 to 27 with an electric current density of 50 A/dm$^2$, to form, on one surface of the cold-rolled steel sheet, a galvanizing layer comprising zinc oxide or zinc hydroxide.

For comparison purposes, only an oxidizer was added, or an oxidizer and a complexing agent in an amount outside the scope of the method of the present invention were added, as shown also in Table 1, to the above-mentioned fundamental electrogalvanizing solution, to prepare acidic electrogalvanizing solutions outside the scope of the present invention (hereinafter referred to as the "electrogalvanizing solutions for comparison") Nos. 1 to 27. Then, a cold-rolled steel sheet having a thickness of 0.8 mm was electrogalvanized in each of the electrogalvanizing solutions for comparison Nos. 1 to 27 with an electric current density of 50 A/dm$^2$, to form, on one surface of the cold-rolled steel sheet, a galvanizing layer comprising zinc oxide or zinc hydroxide.

TABLE 1

| | Oxidizer | | Complexing agent | | Weight of | Spot weld- |
|---|---|---|---|---|---|---|
| No. | Kind | Content (ppm) | Kind | Content (moles/l) | plating layer (g/m$^2$) | ability (number of welding runs) |
| | Electrogalvanizing solution of the invention | | | | | |
| 1 | Nitric acid ions | 10 | Sodium citrate | 0.005 | 0.05 | 5,500 |
| 2 | Nitric acid ions | 400 | Sodium citrate | 0.050 | 0.20 | 6,000 |

TABLE 1-continued

| No. | Oxidizer Kind | Oxidizer Content (ppm) | Complexing agent Kind | Complexing agent Content (moles/l) | Weight of plating layer ($g/m^2$) | Spot weldability (number of welding runs) |
|---|---|---|---|---|---|---|
| 3 | Nitric acid ions | 1,500 | Sodium citrate | 0.100 | 1.00 | 7,000 |
| 4 | Bromic acid ions | 600 | Sodium citrate | 0.050 | 1.00 | 6,500 |
| 5 | Selenic acid ions | 100 | Sodium citrate | 0.050 | 1.00 | 7,000 |
| 6 | Iodic acid ions | 200 | Sodium citrate | 0.050 | 1.00 | 7,500 |
| 7 | Hydrogen peroxide | 100 | Sodium citrate | 0.050 | 1.00 | 7,000 |
| 8 | Nitrous acid ions | 800 | Sodium citrate | 0.050 | 1.00 | 6,500 |
| 9 | Nitric acid ions | 5 | EDTA—Na | 0.005 | 0.05 | 5,000 |
| 10 | Nitric acid ions | 100 | EDTA—Na | 0.050 | 0.20 | 5,500 |
| 11 | Nitric acid ions | 800 | EDTA—Na | 0.100 | 1.00 | 6,000 |
| 12 | Bromic acid ions | 300 | EDTA—Na | 0.050 | 1.00 | 5,000 |
| 13 | Selenic acid ions | 50 | EDTA—Na | 0.050 | 1.00 | 6,000 |
| 14 | Iodic acid ions | 150 | EDTA—Na | 0.050 | 1.00 | 7,000 |
| 15 | Hydrogen peroxide | 50 | EDTA—Na | 0.050 | 1.00 | 6,500 |
| 16 | Nitrous acid ions | 300 | EDTA—Na | 0.050 | 1.00 | 5,500 |
| 17 | Nitric acid ions | 200 | Sodium tartrate | 0.200 | 1.00 | 5,500 |
| 18 | Bromic acid ions | 150 | Sodium tartrate | 0.200 | 1.00 | 5,500 |
| 19 | Selenic acid ions | 25 | Sodium tartrate | 0.200 | 1.00 | 6,000 |
| 20 | Iodic acid ions | 100 | Sodium tartrate | 0.200 | 1.00 | 5,500 |
| 21 | Hydrogen peroxide | 150 | Sodium tartrate | 0.200 | 1.00 | 7,000 |
| 22 | Nitrous acid ions | 200 | Sodium tartrate | 0.200 | 1.00 | 5,000 |
| 23 | Nitric acid ions | 1,500 | Sodium oxalate | 0.070 | 1.00 | 5,000 |
| 24 | Hydrogen peroxide | 500 | Sodium oxalate | 0.070 | 1.00 | 5,500 |
| 25 | Nitric acid ions | 2,000 | CyDTA | 1.000 | 1.00 | 5,000 |
| 26 | Nitric acid ions | 1,800 | DTPA | 1.500 | 1.00 | 6,000 |
| 27 | Nitric acid ions | 1,500 | GEDTA | 0.800 | 1.00 | 6,000 |
| | | Electrogalvanizing solution for comparison | | | | |
| 1 | Nitric acid ions | 20 | — | — | 1.50 | 500 |
| 2 | Nitric acid ions | 400 | — | — | 1.80 | 600 |
| 3 | Nitric acid ions | 1,500 | — | — | 3.00 | 500 |
| 4 | Bromic acid ions | 600 | — | — | 2.00 | 400 |
| 5 | Selenic acid ions | 100 | — | — | 1.80 | 500 |
| 6 | Iodic acid ions | 200 | — | — | 2.50 | 500 |
| 7 | Hydrogen peroxide | 100 | — | — | 1.90 | 500 |
| 8 | Nitrous acid ions | 800 | — | — | 2.10 | 500 |
| 9 | Nitric acid ions | 10 | — | — | 1.20 | 300 |
| 10 | Nitric acid ions | 100 | — | — | 1.30 | 500 |
| 11 | Nitric acid ions | 800 | — | — | 2.10 | 1,500 |
| 12 | Bromic acid ions | 300 | — | — | 1.80 | 600 |
| 13 | Selenic acid ions | 50 | — | — | 1.50 | 1,000 |
| 14 | Iodic acid ions | 150 | — | — | 2.00 | 1,000 |
| 15 | Hydrogen peroxide | 50 | — | — | 1.20 | 1,000 |
| 16 | Nitrous acid ions | 300 | — | — | 1.50 | 1,000 |
| 17 | Nitric acid ions | 200 | — | — | 1.20 | 560 |
| 18 | Bromic acid ions | 150 | — | — | 1.30 | 400 |
| 19 | Selenic acid ions | 25 | — | — | 1.30 | 600 |
| 20 | Iodic acid ions | 100 | — | — | 1.80 | 1,000 |
| 21 | Hydrogen peroxide | 150 | — | — | 2.30 | 800 |
| 22 | Nitrous acid ions | 200 | — | — | 1.30 | 1,000 |
| 23 | Nitric acid ions | 1,500 | — | — | 2.50 | 800 |
| 24 | Nitric acid ions | 2,000 | — | — | 3.50 | 900 |
| 25 | Hydrogen peroxide | 500 | — | — | 3.00 | 900 |
| 26 | Nitric acid ions | 5 | EDTA—Na | 0.0005 | 0.02 | 600 |
| 27 | Nitric acid ions | 5 | EDTA—Na | 15.000 | 0.05 | 700 |

For each of the electrogalvanized steel sheets manufactured with the use of the electrogalvanizing solutions of the invention Nos. 1 to 27 and the electrogalvanizing solutions for comparison Nos. 1 to 27, the weight of the plating layer and spot weldability were investigated. For the investigation of spot weldability, spot welding was continuously applied with the use of a pair of electrode tips to two electrogalvanized steel sheets from among those manufactured with the use of the electrogalvanizing solutions of the invention Nos. 1 to 27 and the electrogalvanizing solutions for comparison Nos. 1 to 27. Spot weldability was evaluated by means of the number of welding runs of the above-mentioned pair of electrode tips, with which an appropriate nugget having a diameter of at least a prescribed value could be formed on the joint of these two electrogalvanized steel sheets.

The results of the investigation regarding the above-mentioned weight of the plating layer and spot weldability are shown also in Table 1. As shown in Table 1, each of the electrogalvanized steel sheets manufactured with the use of the electrogalvanizing solutions for comparison Nos. 1 to 25, which contained an oxidizer but did not contain a complexing agent, showed an excessive weight of the plating layer and a poor spot weldability as represented by a number of welding runs of from 300 to 1,500, with furthermore a poor workability of the electrogalvanized steel sheet.

The electrogalvanized steel sheet manufactured with the use of the electrogalvanizing solution for comparison No. 26, which contained both an oxidizer and a complexing agent but had a low content of the complexing agent outside the scope of the method of the present invention, showed a very small weight of the plating layer and a poor spot weldability as represented by a number of welding runs of 600. The electrogalvanized steel sheet manufactured with the use of the electrogalvanizing solution for comparison No. 27, which contained both an oxidizer and a complexing agent but had a high content of the complexing agent outside the scope of the method of the present invention, showed a poor spot weldability as represented by a number of welding runs of 700, and a burnt deposit was produced on the galvanizing layer to result in a deteriorated quality of the product, and moreover, the electrolytic efficiency of the electrogalvanizing solution was degraded.

As described above, according to the electrogalvanizing solutions for comparison Nos. 1 to 27, it was impossible to stably manufacture an electrogalvanized steel sheet excellent in spot weldability.

In contrast, each of the electrogalvanized steel sheets manufactured with the use of the electrogalvanizing solutions of the invention Nos. 1 to 27, had a weight of the plating layer within the proper range, and showed an excellent spot weldability as represented by a number of welding runs of from 5,000 to 7,500. Moreover, decrease in the electrolytic efficiency of the electrogalvanizing solution or degradation of the product quality caused by a burnt deposit never occurred, with a satisfactory workability of the electrogalvanized steel sheet.

It was therefore possible, according to the electrogalvanizing solutions of the invention Nos. 1 to 27, to stably manufacture an electrogalvanized steel sheet excellent in spot weldability.

EXAMPLE 2

An oxidizer and a pH buffer in an amount within the scope of the method of the present invention were added, as shown in Table 2, to the same fundamental electrogalvanizing solution as in Example 1, to prepare acidic electrogalvanizing solutions of the present invention (hereinafter referred to as the "electrogalvanizing solutions of the invention") Nos. 28 to 41. Then, a cold-rolled steel sheet having a thickness of 0.8 mm was electrogalvanized in each of the electrogalvanizing solutions of the invention Nos. 28 to 41 under the same conditions as in Example 1, to form, on one surface of the cold-rolled steel sheet, a galvanizing layer comprising zinc oxide or zinc hydroxide.

For comparison purposes, only an oxidizer was added, or an oxidizer and a pH buffer in an amount outside the scope of the method of the present invention were added, as shown also in Table 2, to the same fundamental electrogalvanizing solution as in Example 1, to prepare acidic electrogalvanizing solutions outside the scope of the present invention (hereinafter referred to as the "electrogalvanizing solutions for comparison") Nos. 28 to 30. Then, a cold-rolled steel sheet having a thickness of 0.8 mm was electrogalvanized in each of the electrogalvanizing solutions for comparison Nos. 28 to 30 under the same conditions as in Example 1, to form, on one surface of the cold-rolled steel sheet, a galvanizing layer comprising zinc oxide or zinc hydroxide.

TABLE 2

| | Oxidizer | | pH buffer | | | Weight of plating layer | Spot weldability |
|---|---|---|---|---|---|---|---|
| No. | Kind | Content (ppm) | kind | Constituent | Content (g/l) | ($g/m^2$) | (number of welding runs) |
| | | | Electrogalvanizing solution of the invention | | | | |
| 28 | Nitric acid ions | 1,500 | A | Potassium hydrogen phthalate & sodium hydroxide | 20 | 0.1 | 7,000 |
| 29 | Nitric acid ions | 2,000 | B | Sodium tetraborate & sodim hydroxide | 15 | 0.1 | 5,000 |
| 30 | Nitric acid ions | 2,500 | C | Sodium tetraborate & sodium carbonate | 20 | 0.1 | 6,000 |
| 31 | Nitric acid ions | 1,000 | D | Lactic acid & sodium lactate | 20 | 0.1 | 4,500 |
| 32 | Nitric acid ions | 2,000 | E | Boric acid, sodium chloride & sodium carbonate | 10 | 0.1 | 5,0000 |
| 33 | Nitric acid ions | 1,000 | F | Boric acid, sodium chloride & sodium tetraborate | 10 | 0.1 | 6,000 |
| 34 | Nitric acid ions | 1,500 | G | Citric acid & disodium hydrogen phosphate | 10 | 0.1 | 6,500 |
| 35 | Nitric acid ions | 2,000 | H | Sodium carbonate & sodium hydrogencarbonate | 10 | 0.1 | 7,000 |
| 36 | Nitric acid ions | 2,000 | I | Hydrochloric acid & sodium acetate | 10 | 0.1 | 6,000 |
| 37 | Nitric acid ions | 1,600 | J | Disodium hydrogen phosphate & potassium dihydrogen phosphate | 12 | 0.1 | 5,000 |
| 38 | Nitric acid ions | 1,800 | K | Mixed acid solution & sodium hydroxide | 15 | 0.1 | 4,600 |
| 39 | Nitric acid ions | 1,000 | L | Hydrochloric acid & 2.4.6-trimethylpyridine | 15 | 0.1 | 4,500 |
| 40 | Nitric acid ions | 1,000 | M | Potassium dihydrogen phosphate & sodium hydrogencarbonate | 20 | 0.1 | 5,000 |
| 41 | Nitric acid ions | 1,000 | N | Hydrochloric acid & N-ethylmorpholine | 10 | 0.1 | 6,000 |
| | | | Electrogalvanizing solution for comparison | | | | |
| 28 | Nitric acid ions | 1,000 | — | — | — | 1.5 | 500 |
| 29 | Nitric acid ions | 2,500 | C | Sodium tetraborate & sodium carbonate | 0.5 | 0.1 | 600 |
| 30 | Nitric acid ions | 2,500 | C | Sodium tetraborate & sodium carbonate | 70 | 0.1 | 6,000 |

For each of the electrogalvanized steel sheets manufactured with the use of the electrogalvanizing solutions of the invention Nos. 28 to 41 and the electrogalvanizing solutions for comparison Nos. 28 to 30, the weight of the plating layer and spot weldability were investigated as in Example 1. The results of the investigation are shown also in Table 2.

As shown in Table 2, the electrogalvanized steel sheet manufactured with the use of the electrogalvanizing solution for comparison No. 28, which contained an oxidizer but did not contain a pH buffer, showed an excessive weight of the plating layer and a poor spot weldability as represented by a number of welding runs of 500, with furthermore a low workability of the electrogalvanized steel sheet.

The electrogalvanized steel sheet manufactured with the use of the electrogalvanizing solution for comparison No. 29, which contained both an oxidizer and a pH buffer but had a low content of the pH buffer outside the scope of the method of the present invention, showed a poor spot weldability as represented by a number of welding runs of 600. The electrogalvanized steel sheet manufactured with the use of the electrogalvanizing solution for comparison No. 30, which contained both an oxidizer and a pH buffer but had a high content of the pH buffer outside the scope of the method of the present invention, showed spot weldability not improved over that of the electrogalvanized steel sheets manufactured with the use of the electrogalvanizing solutions of the invention, thus leading to a higher cost.

In contrast, each of the electrogalvanized steel sheets manufactured with the use of the electrogalvanizing solutions of the invention Nos. 28 to 41, had the weight of the plating layer within the proper range, and showed an excellent spot weldability as represented by a number of welding runs of from 4,500 to 7,000. Moreover, decrease in the electrolytic efficiency of the electrogalvanizing solution or degradation of the product quality caused by a burnt deposit never occurred, with a satisfactory workability of the electrogalvanized steel sheet. It was therefore possible, according to the electrogalvanizing solutions of the invention Nos. 28 to 41, to stably and economically manufacture an electrogalvanized steel sheet excellent in spot weldability.

According to the present invention, as described above in detail, it is possible to stably and economically manufacture an electrogalvanized steel sheet excellent in spot weldability, which has on at least one surface thereof a galvanizing layer comprising zinc oxide or zinc hydroxide, in an amount appropriate for improving spot weldability, thus providing industrially useful effects.

What is claimed is:

1. In a method for manufacturing an electrogalvanized steel sheet excellent in spot weldability, which comprises the steps of:

electrogalvanizing a steel sheet in an acidic electrogalvanizing solution containing an oxidizer to form, on at least one surface of said steel sheet, a galvanizing layer comprising zinc oxide or a zinc hydroxide;

the improvement wherein:

said acidic electrogalvanizing solution further contains a complexing agent, which has a degree of stability of a complex with zinc of at least 1.0 in the acidic electroplating solution having a pH value of 6, in an amount within a range of from 0.001 to 10 moles per liter of said electrogalvanizing solution, thereby preventing a pH value of said acidic electrogalvanizing solution on an interface with a cathode from decreasing to 5.6 or under and increasing to over 12.

2. In a method for manufacturing an electrogalvanized steel sheet excellent in spot weldability, which comprises the steps of:

electrogalvanizing a steel sheet in an acidic electrogalvanizing solution containing an oxidizer to form, on at least one surface of said steel sheet, a galvanizing layer comprising zinc oxide or a zinc hydroxide;

the improvement wherein:

said acidic electrogalvanizing solution further contains a pH buffer, which has a pH buffering effect in a solution having a pH value within a range of from 5 to 12, in an amount within a range of from 1 to 50 g per liter of said acidic electrogalvanizing solution, thereby preventing a pH value of said acidic electrogalvanizing solution on an interface with a cathode from decreasing to 5.6 or under and increasing to over 12.

3. The method as claimed in claim 1 or 2, wherein:

said galvanizing layer has a weight within a range of from 0.05 to 1.00 g/m$^2$ per surface of said steel sheet.

4. The method as claimed in claim 1, wherein the complexing agent is selected from the group consisting of ethylenediamine disodium tetraacetate, citric acid ions, oxalic acid ions, tartaric acid ions, trans-1,2-cyclohexane-diamine-N,N,N',N'-tetraacetic acid, diethylene triamine pentaacetic acid and ethylenedioxybis (ethylamine)-N,N,N',N'-tetraacetic acid.

5. The method as claimed in claim 2, wherein the pH buffer is selected from the group consisting of Clark-Lubs' pH buffer, S $\phi$ rens' pH buffer, Koltoff's pH buffer, Michaelis' pH buffer, Atkins-Pantin's pH buffer, Palitzsch's pH buffer, McIvaine's pH buffer, Menzel's pH buffer, Walpeole's pH buffer, Hasting-Sendroy's pH buffer, Britton-Robinson's pH buffer, Gomori's pH buffer, Isotonic pH buffer and N-ethylmorpholine-hydrochloric acid pH buffer.

6. The method as claimed in claim 1, wherein the oxidizer is selected form the group consisting of hydrogen peroxide, nitrous acid ions, nitric acid ions, bromic acid ions, iodic acid ions and selenic acid ions.

7. The method as claimed in claim 2, wherein the oxidizer is selected from the group consisting of hydrogen peroxide, nitrous acid ions, nitric acid ions, bromic acid ions, iodic acid ions and selenic acid ions.

8. The method as claimed in claim 1, wherein the acidic electrogalvanizing solution in a solution selected from the group consisting of a sulfuric acid plating solution, a chloride plating solution and a mixed plating solution of sulfuric acid and chloride.

9. The method as claimed in claim 2, wherein the acidic electrogalvanizing solution is a solution selected from the group consisting of a sulfuric acid plating solution, a chloride plating solution and a mixed plating solution of sulfuric acid and chloride.

10. The method as claimed in claim 1, wherein the galvanizing layer has a weight of 0.05 to 1.00 g/m$^2$ per surface of the steel sheet; the complexing agent is selected from the group consisting of ethylenediamine disodium tetraacetate, citric acid ions, oxalic acid ions, tartaric acid ions, trans-1,2-cyclohexane-diamine-N,N,N',N'-tetraacetic acid, diethylene triamine pentaacetic acid and ethylenedioxybis (ethylamine)-N,N,N',N-tetraacetic acid; the oxidizer is selected from the group consisting of hydrogen peroxide, nitrous acid ions, nitric acid ions, bromic acid ions, iodic acid ions and selenic acid ions; and the acidic electrogalvanizing solution is a solution selected from the group consisting of a sulfuric acid plating solution, a chloride plating solution and a mixed plating solution of sulfuric acid and chloride.

11. The method as claimed in claim 2, wherein the galvanizing layer has a weight of 0.05 to 1.00 g/m$^2$ per surface of the steel sheet; the pH buffer is selected from the group consisting of Clark-Lubs's pH buffer, S ϕ rens' pH buffer, Koltoff's pH buffer, Michaelis' pH buffer, Atkins-Pantin's pH buffer, Palitzsch's pH buffer, McIlvaine's pH buffer, Menzel's pH buffer, Walpeole's pH buffer, Hasting-Sendroy's pH buffer, Britton-Robinson's pH buffer, Gomori's pH buffer, Isotonic pH buffer and N-ethylmorpholine-hydrochloric acid pH buffer; the oxidizer is selected from the group consisting of hydrogen peroxide, nitrous acid ions, nitric acid ions, bromic acid ions, iodic acid ions and selenic acid ions; and the acidic electrogalvanizing solution is a solution selected from the group consisting of a sulfuric acid plating solution, a chloride plating solution and a mixed plating solution of sulfuric acid and chloride.

12. The method as claimed in claim 1, wherein the oxidizer is present in an amount of 5 ppm to 1,500 ppm.

13. The method as claimed in claim 2, wherein the oxidizer is present in an amount of 1,000 ppm to 2,000 ppm.

* * * * *

UNITED STATES PATENT AND TRADEMARK OFFICE

CERTIFICATE OF CORRECTION

PATENT NO. : 5,203,986

DATED : April 20, 1993

INVENTOR(S) : Yukimitsu SHIOHARA et al

It is certified that error appears in the above-identified patent and that said Letters Patent is hereby corrected as shown below:

Column 12, line 34, (Claim 5), delete "McIvaine's" and insert --McIlvaine's--.

Column 12, line 48, (Claim 8), delete "in" and insert --is--.

Column 14, line 10, (Claim 12), delete "1,500" and insert --2,000--.

Signed and Sealed this

Sixth Day of September, 1994

*Attest:*

*Attesting Officer*

BRUCE LEHMAN

*Commissioner of Patents and Trademarks*